United States Patent [19]

Salvat et al.

[11] 4,357,612

[45] Nov. 2, 1982

[54] MULTIMODE ULTRAHIGH-FREQUENCY SOURCE AND ANTENNA

[75] Inventors: Francois Salvat; Jean Bouko; Claude Coquio, all of Paris, France

[73] Assignee: Thomson-CSF, Paris, France

[21] Appl. No.: 240,899

[22] Filed: Mar. 5, 1981

[30] Foreign Application Priority Data

Mar. 7, 1980 [FR] France ..... 80 05199

[51] Int. Cl.[3] ..... H01Q 13/02

[52] U.S. Cl. ..... 343/786; 343/772

[58] Field of Search ..... 343/776, 772, 778, 786

[56] References Cited

U.S. PATENT DOCUMENTS

| | | | |
|---|---|---|---|
| 3,308,469 | 3/1967 | Drabowitch | 343/786 |
| 3,701,163 | 10/1972 | Grabowski | 343/786 |
| 3,883,877 | 5/1975 | Chabah et al. | 343/786 |
| 4,241,353 | 12/1980 | Salvat et al. | 343/786 |

*Primary Examiner*—David K. Moore

*Attorney, Agent, or Firm*—Karl F. Ross

[57] ABSTRACT

A multimode ultrahigh-frequency source with wide passband comprises a rectangular waveguide with a cavity terminating at an exit aperture in a horizontally flared horn, an input end of the cavity remote from the horn being joined at a transverse discontinuity plane to an upper and a lower pair of symmetrically disposed rectangular supply guides that are vertically separated from each other. An obstruction in the form of a block located between the levels of the supply guides extends from the discontinuity plane forward into the cavity and converges toward the horn in the vertical E-plane, e.g. with a trapezoidal cross-section. With the supply guides excited in the basic $TE_{10}$ mode, a suitable dimensioning of the block will maintain a cophasal relationship between this basic mode and a hybrid mode $EM_{12}$, originating at the discontinuity plane, in the exit aperture of the cavity over a wide frequency band.

6 Claims, 11 Drawing Figures

PRIOR ART

PRIOR ART

MULTIMODE ULTRAHIGH-FREQUENCY SOURCE AND ANTENNA

FIELD OF THE INVENTION

Our present invention relates to multimode ultrahigh-frequency sources feeds as well as to so-called monopulse antennae incorporating same.

BACKGROUND OF THE INVENTION

In monopulse antennae, several radiation patterns are used simultaneously and their shapes have a direct influence on the overall performance of the radar system including such antennae. Monopulse techniques use in fact simultaneously several patterns coming from the same antenna; in so-called amplitude operation, a distinction is made on the one hand between a pattern with even symmetry or 'sum' pattern serving as a reference and, on the other hand, patterns with odd symmetry or 'difference' patterns giving elevation and azimuthal angular-deviation-measurement signals with respect to the axis of the antenna.

In so-called 'phase' operation, the angular-deviation-measurement signals are obtained by comparing the phase between two patterns having the same amplitude function. It should moreover be noted that it is possible to pass from one operating mode to the other by means of a coupler system, so that in the rest of this description only the case of amplitude operation will be considered.

In these different operating modes, the patterns used are represented mathematically by orthogonal functions, which involves decoupling the corresponding channels.

On the other hand, the different radiating characteristics of these patterns, which have a direct influence on the performance of the system, are not a priori independent but are interlinked by restricting relationships depending on the structure of the antenna. These characteristics are the gain and the level of the side lobes in the sum channel and the difference channels, the slope in the vicinity of the axis and the level of the main lobes in the difference channels.

For a given antenna structure, the problem raised is tantamount to trying to find an optimization between the factors which have been already mentioned, with consideration given to their relative ranking imposed by the functions of the system considered. It may be deduced therefrom that any structure possesses an optimization field, but conventional antennae structures have shown their limits in the case of monopulse techniques. In fact it has proved impossible in conventional monopulse antennae to control independently the sum and difference patterns for properly controlling the shape of the illumination function for the primary source, which is particularly important in the construction of low-noise antennae for radio astronomy and spatial telecommunication. The conventional monopulse technique has also shown its limits in the application to telecommunication antennae for tropospheric transmission in which the diversity between the sum and difference channels is utilized.

To remedy these limitations, multimode sources have been developed for use in antennae of corresponding type.

A multimode source or moder is capable, by virtue of its peculiar structure, of generating direct propagating modes with controllable phases and amplitudes allowing a desired illumination in its aperture to be obtained.

Generally, a moder is a structure formed of waveguides comprising discontinuities at which higher modes are generated.

A study of such moders may be found, among others, in French Pat. No. 1,290,275 and our commonly owned prior U.S. Pat. No. 4,241,353 which relates to a combined multimode structure formed by combining an E-plane moder with an H-plane moder, as shown in present FIG. 1 which is representative of the prior art.

Such a structure allows independent control of the sum and difference patterns to be obtained in the E and H planes. However, such control does not take place simultaneously in these planes but successively.

The structure of FIG. 1 is formed by two flat moders $ME_1$, $ME_2$ placed side by side and separated by a common vertical partition. Each of these moders is energized by two pairs of guides 1, 10 and 2, 20 which receive the basic mode and which open into a guide 3, 30 of a length $L_1$ between planes $P_0$ and $P_1$. Plane $P_0$ is what is called the plane of discontinuity at which there are formed higher modes, propagating or evanescent, length $L_1$ and the dimensions of guides 3, 30 being such that only the desired modes, in this case for example the odd modes $H_{11}$ and $E_{11}$ and the even modes $H_{12}$ and $E_{12}$, are propagated as far as the opening of the E-plane moder thus formed, i.e. the plane $P_1$, the basic mode being the mode $H_{10}$.

Starting at plane $P_1$ are H-plane moders designed to provide the desired distribution functions in the horizontal plane without distorting the distribution functions established in the vertical plane by the E-plane moders $ME_1$ and $ME_2$. Metal plates 4, 40, 5, 50, 6, 60 disposed horizontally in a guide 8, 80 of length $L_2$, forming a continuation of guides 3 and 30 beyond plane $P_1$, define four pairs of adjacent horizontal flat guides which adjoin each other at their small sides and are energized in accordance with the distribution functions defined by the moders $ME_1$ and $ME_2$. The horizontal plates extend beyond plane $P_2$ in a guide 7 having the shape of a horn of length $L_3$.

The assembly located between planes $P_1$ and $P_3$ forms a stack of H-plane moders, plane $P_2$ being the plane of discontinuity where higher modes are formed. The aperture of the combined structure, which is located in a plane $P_3$, radiates according to an overall illumination function, which is a product of the partial illumination functions obtained in the vertical plane and in the horizontal plane.

Multimode sources or feeds of the kind just described are used in radar antennae, more particularly in tracking radar, but they have the drawback of requiring considerable space in the longitudinal direction, which is troublesome for the construction of certain antennae in which an improved performance, principally regarding the passband, causes an increase in inertia impairing the operation of the servo-mechanisms.

In our above-identified prior patent we have disclosed a multimode feed free from the aforementioned disadvantages, comprising a structure for a combined E-plane and H-plane moder by which, besides a reduction in the dimensions of the source, an increase of the passband in the H-plane is realized.

FIG. 2 gives a view of such a moder in which the increase of the passband is obtained by providing the aperture 16 of a horizontally flared horn 13 with vertical metal bars or strips 14, 15 and 140, 150 disposed parallel to the electric field of the emitted wave.

OBJECT OF THE INVENTION

The object of our present invention is to provide a multimode feed structure free from the drawbacks of the prior art having means for increasing the passband of the transmitted signals, principally in the E plane.

SUMMARY OF THE INVENTION

A multimode structure according to our invention comprises a main waveguide forming a cavity of rectangular cross-section which is bisected by an E plane and an H plane, these two planes intersecting in a longitudinal axis. Two pairs of supply guides, also of rectangular cross-section with broad faces parallel to the H plane, are symmetrically disposed about that axis and are separated from each other by a central longitudinal zone having boundaries parallel to the H plane, these guides opening into the cavity at an inlet thereof lying in a transverse plane referred to hereinafter as the discontinuity plane. An exit end of the cavity, disposed in a transverse aperture plane, adjoins a horn which diverges outward in the H plane. This structure essentially conforms to that of our above-identified prior patent and may further include laterally disposed metal bars perpendicular to the H plane as likewise disclosed in that patent.

In accordance with our present improvement, an obstruction in the form of a block centered on the longitudinal cavity axis extends over a fraction of the length of the cavity from the discontinuity plane toward the aperture plane. This block has an E-plane cross-section which symmetrically coverges toward the H plane so as, in effect, to prolong and progressively broaden the outlet ends of the supply guides. A phase center of outgoing radiation, defined as a point of cophasal relationship between a fundamental excitation mode and a hybrid mode generated at the junctions of the supply guides with the main cavity, is substantially stabilized by this means over an extended frequency band at the intersection of the longitudinal axis with the aperture plane as will be more fully described hereinafter.

BRIEF DESCRIPTION OF THE DRAWING

The above and other features of the invention will appear in greater detail from the following description given with reference to the accompanying drawing in which.

SPECIFIC DESCRIPTION

Figure 1:
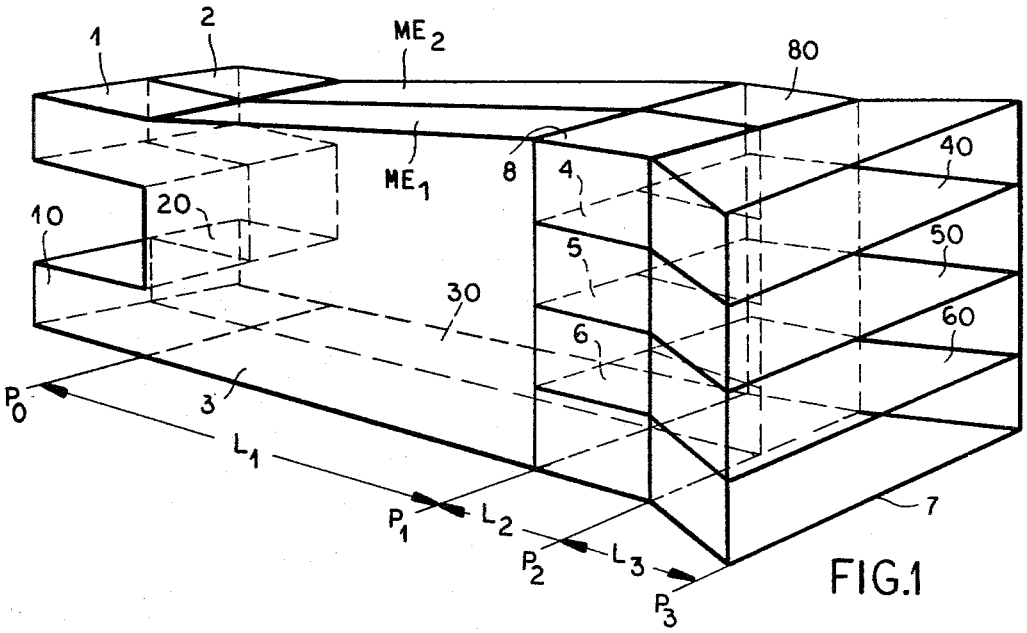
FIG.1 PRIOR ART
FIGS. 1 and 2, already referred to, represent the state of the art.
Figure 2:
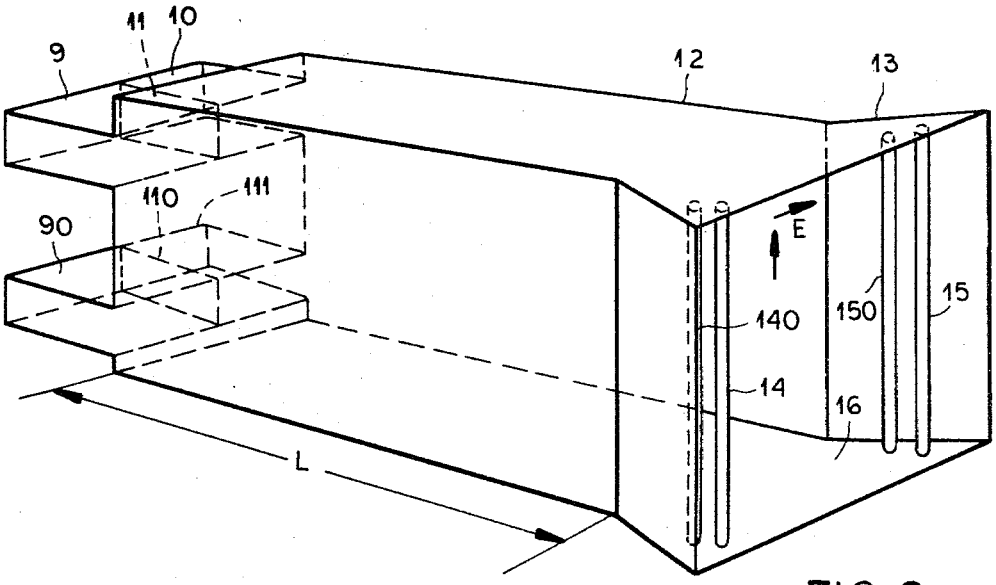
Figure 3:
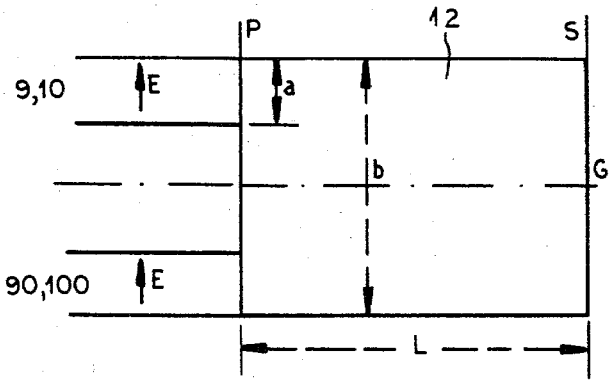
FIG.3 PRIOR ART
FIG. 3 shows a conventional E-plane moder in longitudinal section.
Figure 4:
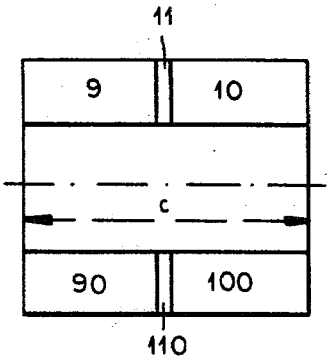
FIG. 4 shows the E-plane moder of FIG. 3 in an end view.
Figure 5:
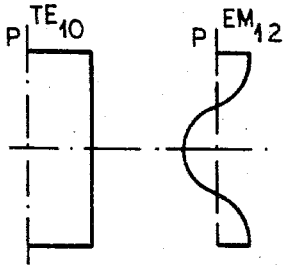
FIG. 5 shows a pair of curves representing the modes present at the output of the supply guides of the moder.
Figure 6:
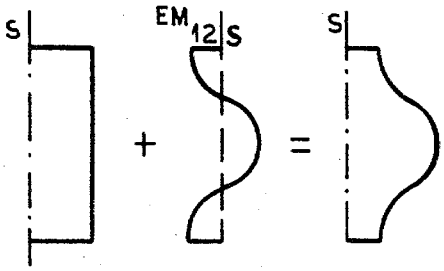
FIG. 6 shows three curves representing the illumination function in the plane of the moder.

We shall first refer to FIGS. 3 and 4 for a discussion of the construction and the operation of the conventional E-plane moder shown in FIG. 2 wherein an upper pair of adjacent supply guides 9, 10 and a lower pair of such guides 90, 100 are separated by respective partitions 11 and 110. These supply guides open into a cavity 12 at a so-called discontinuity plane P. The aperture of the cavity lies in a plane S. The dimensions a, b, c respectively represent respectively the height of the supply guides parallel to the electric field E, the height of cavity 12 of the E plane moder here considered and the width of the moder. Since the four supply guides are fed in phase in the basic mode $TE_{10}$ (or $H_{10}$) there is created at the discontinuity plane P a hybrid higher mode $EM_{12}$ composed of modes $TE_{12}$ and $TM_{12}$. There are shown in FIG. 5 the patterns of these modes in plane P and in FIG. 6 the illumination function in the plane S of the exit aperture of the moder, resulting from the superimposition of modes $TE_{10}$ and $EM_{12}$.

The ratio $\beta$ of the hybrid mode $EM_{12}$ to the basic mode is given by:

$$\beta = 2\frac{\sin 2\pi\frac{a}{b}}{2\pi\frac{a}{b}} \tag{1}$$

and is independent of frequency, not only in amplitude but also in phase.

The relative phase $\phi$ between the two modes in the aperture plane S of the moder of FIG. 2 is given by:

$$\phi = \frac{2\pi L}{\lambda}\left[\sqrt{1-\left(\frac{\lambda}{2c}\right)^2} - \sqrt{1-\left(\frac{\lambda}{2c}\right)^2-\left(\frac{\lambda}{b}\right)^2}\right] \tag{2}$$

where $\lambda$ is the free-space wavelength of the emitted ultrahigh-frequency radiation. It can be seen that the phasing of the modes in the plane S is a function of frequency. According to the prior art, a suitable selection the length L of the moder can make the differential phase shift at the central frequency of the operating band equal to $\pi$, such precise phasing being thus realized only for a single frequency. It is therefore not possible to obtain a relatively wide passband under satisfactory conditions since any deviation from the central frequency of the band shifts the phase center of the source which forms the moder; situated approximately at point G for the central frequency, i.e. at the midpoint of the cavity aperture, the phase center deviates therefrom to the right for decreasing frequencies and to the left for increasing frequencies. The variation of this phase center causes poor illumination at the aperture and a poor radiation pattern of the source with appearance of considerable side lobes and widening of the principal lobe, entailing a loss in gain for increasing frequencies and a narrowing of the beam for decreasing frequencies; for a given radiation direction ($\theta_o$), therefore the width of pattern varies with the frequency.

The following mathematical expression can be given for the E-plane radiation pattern of the source of FIG. 3:

$$D_E = \frac{\sin u}{|\beta|} = \frac{2 \sin \frac{2\pi a_b}{b}}{\frac{2\pi a_b}{b}} \quad (4)$$

where $u = (\pi b/\lambda)\sin\theta$, $\theta$ being the angle of the radiation pattern with respect to the source. This formula enables the primary radiation pattern to be determined and the incidence levels at the reflector illuminated by the source to be defined.

From the foregoing expression the conditions may be determined under which, in accordance with the invention, the source which forms the E-plane moder will have an increased passband without presenting the drawbacks of prior moders.

In order to widen the operating frequency band, it is thus necessary for the amplitude of the pattern radiated at an angle $\theta_o$ to be not much affected by frequency. The study of relationships (1) and (3) shows that the ratio $|\beta|$ of the hybrid mode $EM_{12}$ to the basic mode $TE_{10}$ must increase with frequency.

Figure 7:
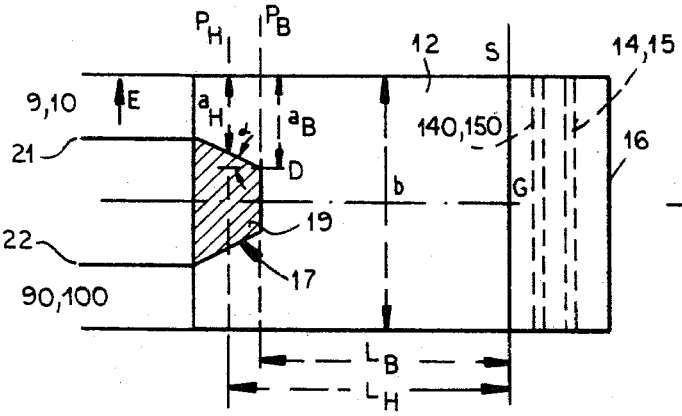
FIG. 7 is a sectional view of an E-plane moder according to our invention provided with a tapering obstruction.

The phasing of modes $EM_{12}$ and $TE_{10}$ must remain constant in the aperture of the moder, and this over the whole band considered; the study of relationship (2) shows that this constancy is obtained if the plane giving rise to hybrid mode $EM_{12}$ seems to move leftward in FIG. 3 when the frequency increases and rightward in the opposite case. We achieve this result with the structure of FIGS. 7 and 8 which includes most of the elements described with reference to FIGS. 2–4. FIG. 7 also shows the horn 13 and its bars 14, 15, 140, 150 extending parallel to the electric field as in FIG. 2.

Whereas in the prior-art moder an abrupt transition from the supply guides 9, 10, 90, 100 to cavity 12 takes place at the so-called discontinuity plane P, parallel to electric field E, our invention provides for the presence on a part of this plane P, between the upper and lower supply guides, of a profiled obstruction 17 whose shape and dimensions modify the frequency dependence of the modes created in the zone where the obstruction is located. This obstruction 17 projects into the cavity 12 with a decreasing cross-sectional area and is symmetrical about the mutually perpendicular midplanes of that cavity.

Figure 8:
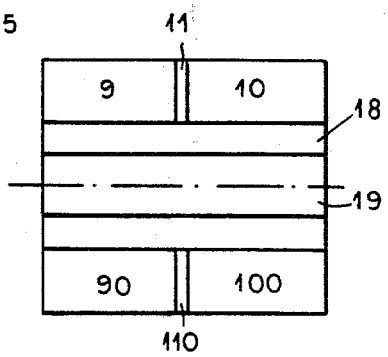
FIG. 8 shows the moder of FIG. 7 in an end view.
Figure 9:
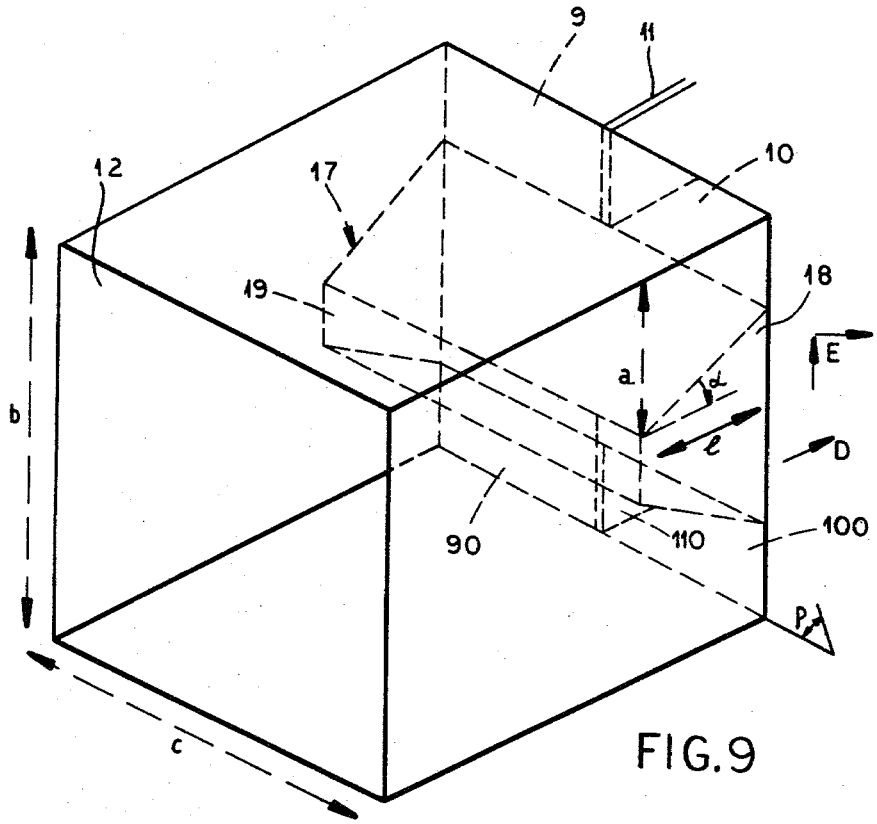
FIG. 9 is a perspective view of the E-plane mode according to the invention.

In accordance with the embodiment shown in FIGS. 7–9, this obstruction is in the shape of a block having a trapezoidal cross-section in the E plane whose major base 18 is located in plane P between levels 21 and 22 which are the bondaries of a central longitudinal zone separating the upper and lower guides 9, 10 and 90, 100. The minor base 19 is a rectangular end face located at a distance l from plane P, inside cavity 12, and is spaced from the upper wall of the cavity by a distance $a_B$ measured parallel to the electric field E. This distance decreases progressively from the minor to the major base, passing through a value $a_H$ in an intermediate plane $P_H$ separated by a distance $L_H$ from plane S.

The sloping sides of block 17, between its major and the minor bases, include an angle of convergence $\alpha$ with the axial direction D perpendicular to plane P. The other dimensions of the moder are, as before, height b and width c. The operation of the E-plane moder according to our invention is as follows:

On account of the shape of the obstruction 17 one of whose bases is located in the discontinuity plane P, the higher modes, principally the hybrid mode $EM_{12}$, are not created at this plane P but in different short-circuit planes whose locations depend on the operating frequencies.

Thus, at low frequencies the excitation plane for hybrid mode $EM_{12}$ is the plane $P_B$ of the minor base of the trapezoidal block 17. The phasing length is then $L_B$, measured between planes $P_B$ and S. The absolute magnitude or modulus of the mode ratio is given by $$|\beta| = \frac{2 \sin \frac{2\pi a_B}{b}}{\frac{2\pi a_B}{b}} \quad (4)$$

At high frequencies, the excitation plane for hybrid mode $EM_{12}$ is the intermediate plane $P_H$. The phasing length is the distance $L_H$ between planes $P_H$ and S. The ratio modulus of the modes assumes the following form:

$$|\beta| = \frac{2 \sin \frac{2\pi a_H}{b}}{\frac{2\pi a_H}{b}} \quad (5)$$

The conditions which have been set forth for the moder to operate with a wide passband, namely that the mode ratio $|\beta|$ increases with frequency and the excitation plane for hybrid mode $EM_{12}$ shift leftward i.e. toward the source for increasing frequencies, causing $L_H$ to be greater than $L_B$, are thus fulfilled. Both lengths $L_B$ and $L_H$ are significantly larger than the axial length l of block 17.

There may be determined by calculation an optimum value for the convergence angle $\alpha$ of the trapezoid flanks so that the preceding conditions are achieved in a very wide band of frequencies, this angle $\alpha$ being able to vary theoretically between 0° and 90°. For this purpose we have calculated the modulus and of the argument of expression $\beta$ representing the ratio of the higher mode to the basic mode at the plane of discontinuity.

Figure 11:
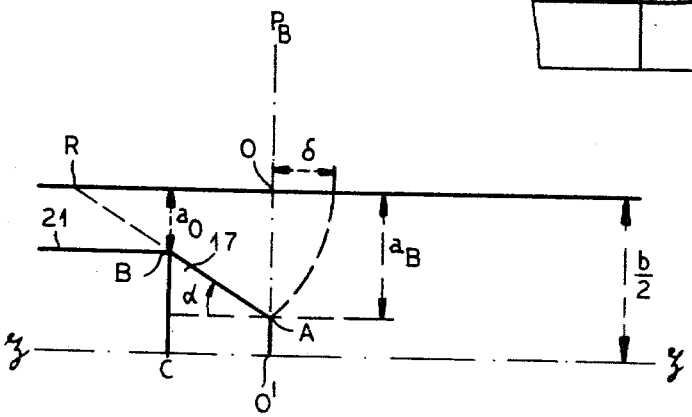
FIG. 11 is a diagram serving to explain the calculation of the optimum convergence angle of the obstruction inserted into the moder of FIGS. 7–9.

We shall explain this calculation with reference to FIG. 11 schematically indicating the upper part of the structure of FIG. 7 above. This FIG. 11 takes up again FIG. 7, in the upper part thereof above the longitudinal axis z-z of the moder. Block 17 is obviously only partially represented, its profile being marked by the letters C, B, A, O'. The distance from the block to the top wall of the moder in line with plane P is designated by $a_O$, whereas its spacing from that wall in line with plane $P_B$ is again designated $a_B$ and corresponds to the distance A-O. A parameter $\delta$ represents the variation of the phase of the basic mode as a function of frequency.

In the proposed calculation, the higher evanescent modes $EM_{14}$, $EM_{16}$, etc. which appear at the discontinuities in planes $P_B$ and P will be disregarded.

The relationships between the electric fields of the different propagating modes of the source are given by the following equations:

The electric field upstream of plane $P_B$ (line O-O') for mode $TE_{10}$ equals: $e^{ik\delta}$ *where*

$$\delta = a_B \tan \alpha/2$$

$$k = \frac{2\pi}{\lambda_g}$$

and the guided wavelength is $$\lambda_g = \frac{\lambda}{\sqrt{1 - \left(\frac{\lambda}{2c}\right)^2}}$$

Similarly, the electric field downstream of the plane $P_B$ for fundamental mode $TE_{10}$ and hybrid mode $EM_{12} = TE_{12} + TM_{12}$ equals:

$$K\left(1 + \beta \cos \frac{\pi x}{b}\right)$$

where K is a factor of normalization and $\beta$ is the mode ratio in complex form, x being the vertical dimension in FIG. 11.

Integration of the field equations in plane $P_B$ yields:

$$\int_0^a e^{ik\delta}\, dx = \int_0^b K\left(1 + \beta \cos \frac{\pi x}{b}\right) dx \tag{6}$$

$$\text{and } \beta = \frac{2 \int_0^a e^{ik\delta} \cos \frac{\pi x}{b}\, dx}{\int_0^a e^{ik\delta}\, dx};$$

which can be written in the form $|\beta| e^{j\psi}$. It appears from expression (6) that the modulus $|\beta|$ increases with frequency, that the phase difference varies with frequency and that if the moder has a well-defined length, such that the different modes are in phase at aperture plane S, this phase difference decreases, tending to reduce the variation of the differential phase shift between the modes $EM_{12}$ and $TE_{10}$ in the operating frequency band.

The following tables give the results obtained for a conventional moder and a moder embodying our invention.

The first table I gives in a first column the incidence level NR and in a second column the differential phase shift $\Delta\phi$ between the modes for, successively, the high frequency $F_H$, the median frequency $F_M$ and the low frequency $F_B$, this for a conventional moder having a relative passband of 10%, a value $u = (\pi b/\lambda) \sin \theta_o$ between 3.3 and 3.7, and $\beta \simeq 0.8$, the angle $\theta_o$ being the angle of incidence at the reflector of the antenna.

| | | NR | $\Delta\phi$ |
|---|---|---|---|
| I | $F_H$ | −12.3 dB | −17° |
| | $F_M$ | −10.5 dB | 0° |
| | $F_B$ | −9 dB | +23° |

The second table II shows the results obtained with the moder of the present invention, which acts as a wide-band source or feed.

| | | NR | $\Delta\phi$ |
|---|---|---|---|
| II | $F_H$ | −10.3 dB | −7° |
| | $F_M$ | −9.5 dB | 0° |
| | $F_B$ | −9 dB | +9° |

It can be seen from these tables that for a conventional moder (table I) the reduction in level NR is 3.3 dB for a relative bandwidth of 10% when going from the high frequency to the low frequency of the band, whereas for our improved (table II) this variation is reduced to 1.3 dB, proving that the relative bandwidth is increased. Similarly, the differential phase shift goes from 40° for the conventional moder to 16° for the improved moder, also indicating an increased bandwidth. In fact, the relative passband is then of the order of at least 15%. It is also apparent therefrom that, for a value of the modulus of the mode ratio $|\beta|$ comprised between 0.8 and 8.88, the optimum value of angle $\alpha$ is in the vicinity of about 50° within a range of ±10%.

Figure 10:
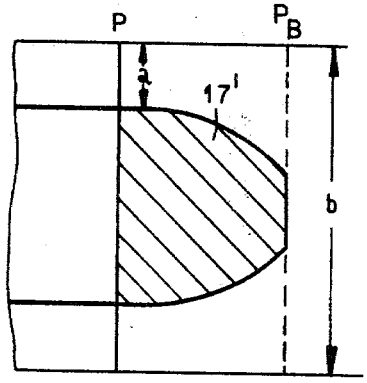
FIG. 10 is a detail view of a variation of the obstruction included in the preceding embodiment of our invention.

FIG. 10 shows a block 17' introduced as an obstruction into an E-plane moder, this block having a modified profile which is no longer a straight-line polygon but has a convex curvature, approaching on exponential function. The results obtained are of the same order as those of the aforedescribed version, possibly slightly better, yet the mechanical construction of such a block is a little more difficult.

What is claimed is:

1. A multimode ultrahigh-frequency source comprising:

a main waveguide forming a cavity of rectangular cross-section bisected by an E plane and an H plane intersecting in a longitudinal axis;

two pairs of supply guides of rectangular cross-section with broad faces parallel to said H plane symmetrically disposed about said longitudinal axis, said pairs being separated from each other by a central longitudinal zone with boundaries parallel to said H plane, said supply guides opening into said cavity at an inlet thereof lying in a transverse discontinuity plane;

a horn adjoining an exit end of said cavity disposed in a transverse aperture plane, said horn diverging in said H plane from said aperture plane outward; and an obstruction in the form of a block centered on said longitudinal axis, said block extending over a fraction of the length of said cavity from said discontinuity plane toward said aperture plane with an E-plane cross-section symmetrically converging toward said H plane for substantially stabilizing a phase center of outgoing radiation at the intersection of said axis with said aperture plane over an extended frequency band, said phase center being a point of cophasal relationship between a fundamental mode of excitation of said supply guides and a hybrid mode generated at the junctions of said supply guides with said cavity.

2. A multimode source as defined in claim 1 wherein said block terminates in a rectangular end face spaced forwardly from said discontinuity plane.

3. A multimode source as defined in claim 2 wherein said block has a trapezoidal cross-section in said E plane.

4. A multimode source as defined in claim 3 wherein said trapezoidal cross-section has flanks including with said H plane an angle on the order of 50°.

5. A multimode source as defined in claim 2 wherein said block has convex surfaces extending between said discontinuity plane and said end face.

6. A multimode source as defined in claim 1, 2, 3, 4 or 5 wherein said horn is provided with laterally disposed metal bars perpendicular to said H plane.

* * * * *